United States Patent [19]

Wiget

[11] 4,084,404

[45] Apr. 18, 1978

[54] ELECTRONIC WATCH

[75] Inventor: Fridolin Wiget, Neuchatel, Switzerland

[73] Assignee: Ebauches S.A., Switzerland

[21] Appl. No.: 753,844

[22] Filed: Dec. 23, 1976

Related U.S. Application Data

[63] Continuation of Ser. No. 603,121, Aug. 8, 1975, abandoned, and a continuation-in-part of Ser. No. 399,717, Sep. 24, 1973, abandoned.

[30] Foreign Application Priority Data

Oct. 17, 1972 Switzerland ..... 15177/72

[51] Int. Cl.[2] ..... G04B 19/30; G04C 3/00; G04B 27/00

[52] U.S. Cl. ..... 58/50 R; 58/23 R; 58/23 D; 58/85.5

[58] Field of Search ..... 58/23 R, 23 D, 58 R, 58/85.5

[56] References Cited

U.S. PATENT DOCUMENTS

| | | | |
|---|---|---|---|
| 3,469,389 | 9/1969 | Nakai | 58/23 TF |
| 3,748,846 | 7/1973 | Kikuchi | 58/26 R |
| 3,800,523 | 4/1974 | Yamazaki | 58/23 R |
| 3,802,182 | 4/1974 | Fujita | 58/50 R |

*Primary Examiner*—Edith S. Jackmon

*Attorney, Agent, or Firm*—Robert E. Burns; Emmanuel J. Lobato; Bruce L. Adams

[57] ABSTRACT

A frequency divider divides a sonic or ultrasonic time base frequency to provide signals with a frequency of N/60 Hz, where N is a whole number comprised between 1 and 16. These signals drive a motor step-by-step, the motor in turn driving minutes and hours hands by one step per pulse. A liquid crystal supplied with a signal of optically perceptible frequency of about 1 Hz can be added, providing a flashing optical display enabling verification of running of the watch.

6 Claims, 5 Drawing Figures

FIG. 4
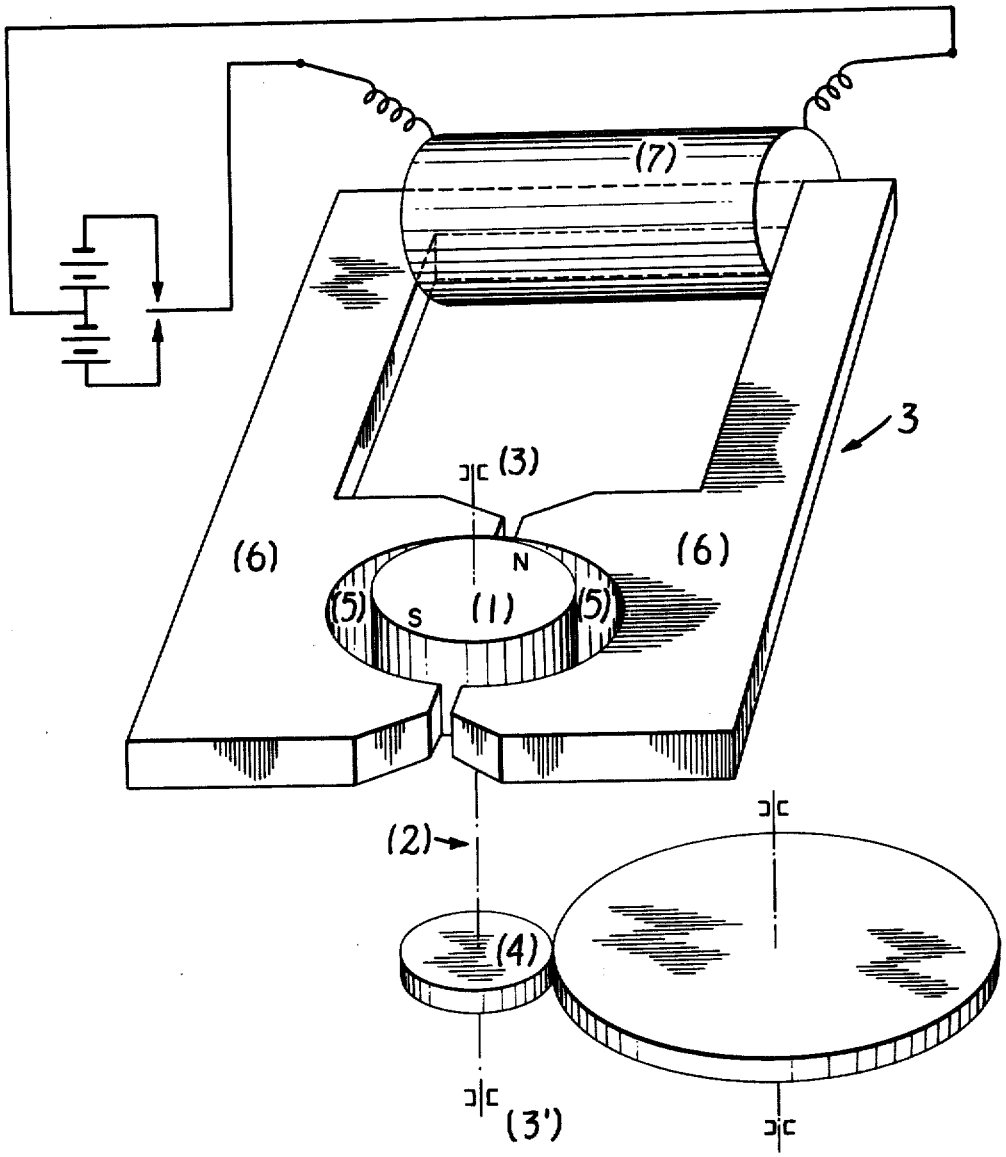
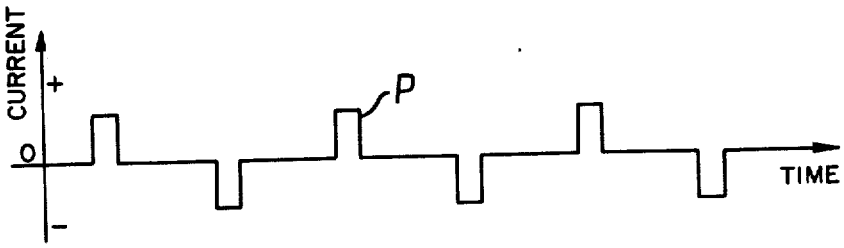
FIG. 5

ELECTRONIC WATCH

CROSS-REFERENCE TO PRIOR APPLICATION

This is a continuation, of application Ser. No. 603,121, filed Aug. 8, 1975 which is now abandoned. This is a continuation-in-part of the earlier application, Ser. No. 399,717 filed Sept. 24, 1973 which is now abandoned.

BACKGROUND OF THE INVENTION

The invention relates to electronic watches of the type comprising a time base, a frequency dividing circuit, and a step-by-step motor driving a time display member such as a minute hand.

Numerous electronic watches of this type are known in which the pulses actuating the motor step-by-step have a frequency no smaller, or usually greater, than one Hertz. In these watches it is necessary, with a view to obtaining an acceptable consumption of electrical energy, to provide these pulses with a very short duration and low intensity, which necessitates the use of step-by-step motors of high performance with very low tolerances, necessarily employing expensive magnets and very fine wire. Apart from their high cost of manufacture, these motors are fragile. Further, in view of their very low nominal power, in order to drive auxiliary members such as calenders without disturbing the running of the motor it is necessary to provide complicated devices.

An object of the invention is to provide a watch of the above-indicated type which is particularly cheap to build and the motor of which is relatively powerful and robust but operable with a relatively low overall consumption of electric current.

SUMMARY OF THE INVENTION

According to the invention, there is provided an electronic watch comprising a time base of sonic or ultrasonic frequency; a frequency divider dividing this frequency and delivering output pulses with a frequency of N/60 Hz, where N is a whole number included between 1 and 16; a step-by-step motor driven step-by-step by these pulses; and a time display member, comprising a minutes display member, driven by this motor by one step per pulse.

BRIEF DESCRIPTION OF THE DRAWINGS

The invention will now be particularly described, by way of example, with reference to the accompanying schematic drawing, in which

FIG. 4 is a perspective view of the motor of the new watch.

FIG. 5 is a diagram of motor drive pulses.

DESCRIPTION OF PREFERRED EMBODIMENTS

Figure 1:
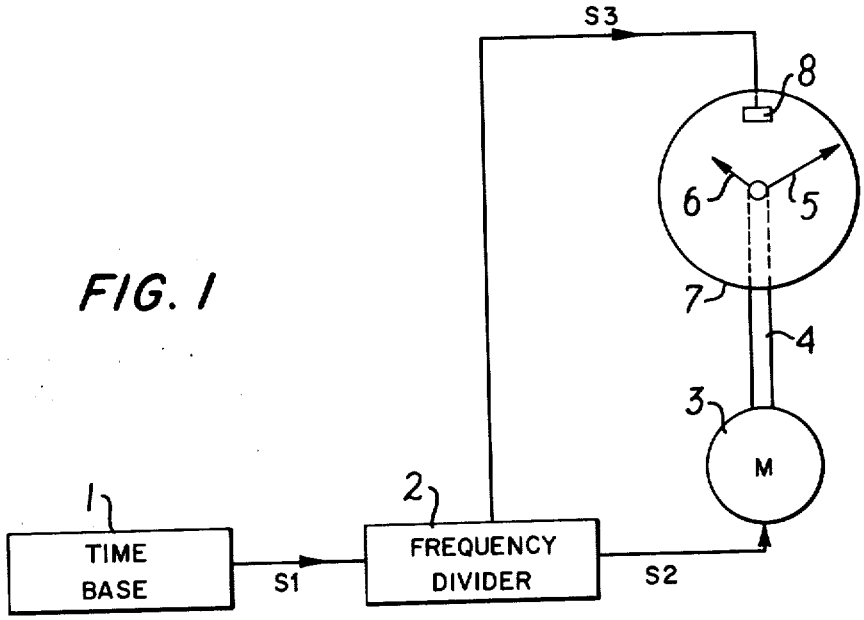
FIG. 1 is a block diagram of a watch according to the invention.

As shown in FIG. 1, the watch comprises a time base 1 providing signals S1 of sonic or ultrasonic frequency, a frequency divider 2 dividing signal S1 and supplying a signal S2 of relatively low frequency to a step-by-step motor 3. Motor 3 has a shaft 4 directly connected to a minutes hand 5, which as illustrated constitutes the most rapidly rotating part of the watch. The motor shaft is further connected (by a conventional 12:1 gear reducing assembly, 23, 24, 25, 26 illustrated in FIG. 2) to an hours hand 5.

These hands 5 and 6 are mounted for rotation above a conventional dial 7, FIG. 1.

Preferably the dial is provided with a window through which at least one liquid crystal cell 8 is visible, which receives a signal S3 from divider 2, to provide an easily perceptible regular optical signal or flashes, for example with a frequency of about one second or a fraction of a second. This optical signal enables the wearer or the watchmaker to instantaneously verify whether the watch is running.

Figure 2:
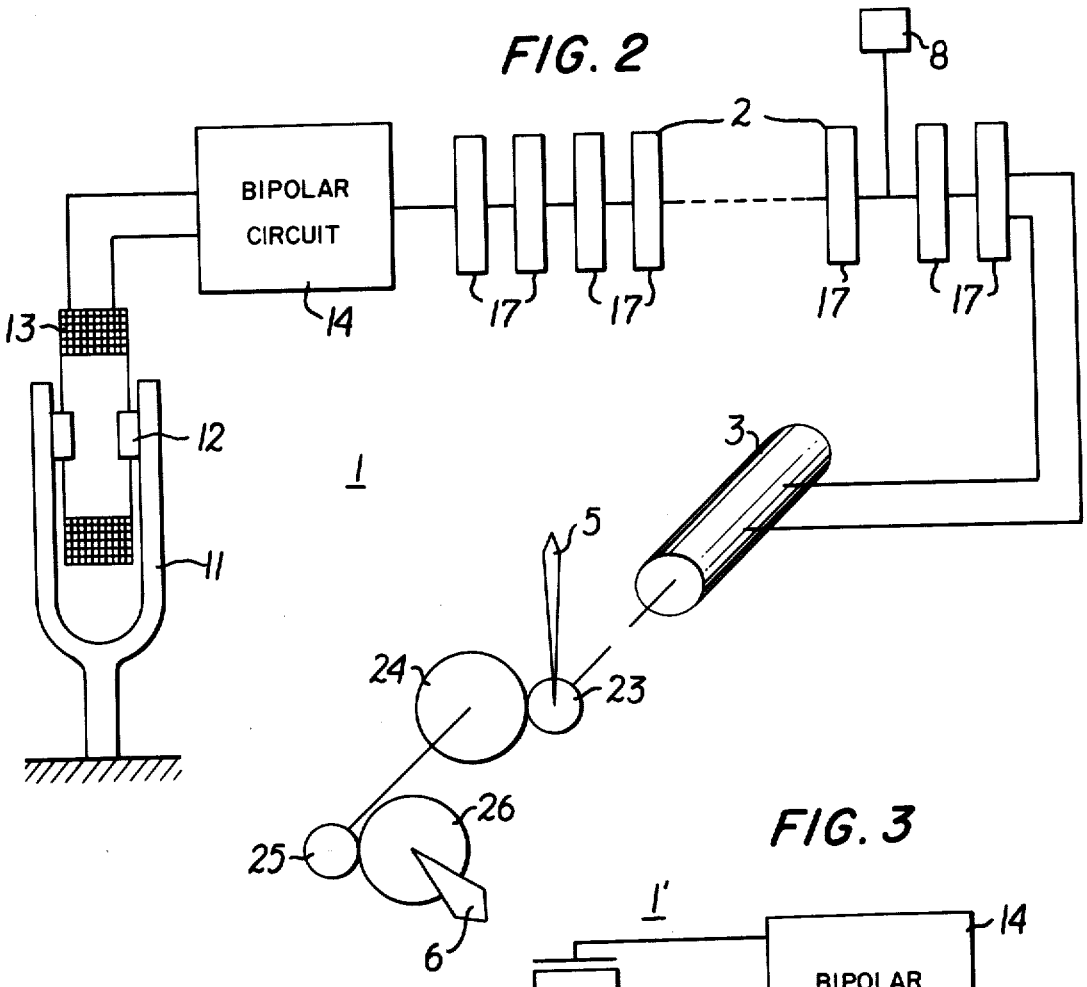
FIGS. 2 and 3 are block diagrams of details showing first and second embodiments of the invention, respectively.

A first example of a time base 1 is shown in FIG. 2. It provides a time base comprising a metal tuning-fork 11, which can oscillate freely at, for example, 2184.533 or 4369.066 Hz at a low amplitude. Such oscillation can be maintained in a known manner by a MOS or bipolar circuit 14. The frequency divider 2 has seventeen or eighteen binary stages 17, depending on the oscillation frequency chosen, to deliver a signal S 2 of 1/60 Hz.

Figure 3:
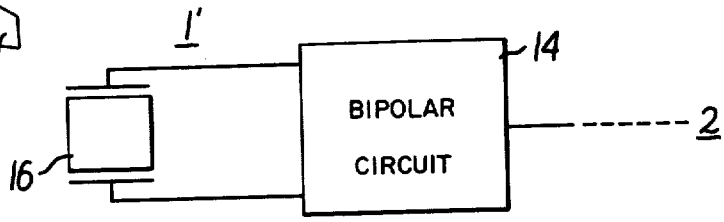

In a second example, shown in FIG. 3, the time base 1' comprises a piezo-electric oscillator such as quartz crystal 16, the frequency of oscillation of which is, for example, 17476. 266 or 34952.533 Hz. In this case, divider 2 has twenty or twenty-one binary stages depending on the frequency of time base 1, to deliver a signal S1 of 1/60 Hz.

In either example, one or more of the binary stages of divider 2 can be removed. It is possible in accordance with the invention to provide pulses of N/60 Hz, wherein N is a whole number, ranging up to 16 and down to 1. These pulses of 1/60 to 1/16 Hertz or cycles per second (16 to 60 seconds per cycle) are used, according to the invention, for the illustrated, direct driving of the most rapidly rotating part of the new wrist watch, that is, of the minutes hand 5. Preferred embodiments of the invention have the parameters shown in the following tabulation, columns B and C.

| PARA-METERS | WATCH A | B | C |
|---|---|---|---|
| winding length, in mm. | 10 | 10 | 10 |
| outer dia. of windng, in mm. | 3 | 3 | 3 |
| inner dia. of winding, in mm. | | | |
| supply voltage, in volts | 1.55 | 1.55 | 1.55 |
| width of driving pulses, in ms. | 10 | 10 | 10 |
| period of driving pulses, in sec. | 1 | 5 | 15 |
| frequency of driving pulses, in Hertz | 1 | 1/5 | 1/15 |
| diameter wire, in microns (μm) | 25 | 25 | 50 |
| number of windings | 10600 | 10600 | 2650 |
| resistance of winding, in ohms | 2300 | 2300 | 144 |
| instantaneous current, in mili. Amp. | 0.675 | 0.675 | 10.8 |
| mean current consumption, micro. Amp | 6.75 | 1.35 | 7.20 |
| magnetic field in winding, in A.T./cm | 7.2 | 7.2 | 28.5 |
| torque on minutes hand, in g. cm | 6 | 1.2 | 1.5 |

It will be seen that the frequencies of the driving pulses, in watches A,B and C, correspond respectively to values of 60, 12 and 4 for the above-mentioned factor N. Watch A uses conventional parameters, while watches B and C are embodiments of the invention.

As shown in FIG. 4 the rotor 1 of the new watch's motor is a radially-magnetized permanent bipolar magnet. Its shaft 2 mounted in bearings 3,3' carries the first wheel 4 of the reducing gear train driving the minutes hand. The rotor is placed in a generally cylindrical airgap 5 of stator 6 in soft magnetic material. When the winding 7 is supplied with a current pulse, (P), as indicated by FIG. 5 the induced magnetic flux in the stator 6 turns the rotor 1 by 180°. The current pulses are bipolar. The air-gap (5) is made slightly assymetric to define a given direction of rotation, as will be understood by persons skilled in the art.

As to the motor parameters, tabulated above, it will be seen that the first five of them are the same for the three watches. The next three parameters are varied. This enables significant advantages to be obtained for some of the remaining parameters in the new watches B and C, as compared with watch A, which has a conventional 1 Hertz supply.

Watch A is a conventional gentlemen's wristwatch with a second hand, supplied with a 150mAh cell giving a useful life of about 1 year. The torque of 6 g. cm on the minutes hand is sufficient to enable also driving a simple calendar mechanism.

Watch B is a small ladies' wristwatch without a seconds hand, the minutes hand 5 being its most rapidly rotating part, as shown and explained. Advantageously, the watch is also free of a calendar mechanism. In this watch the small space available enables use of a cell of only 50 mAh. A useful life of 1 year is required. As the electronic circuit consumes about 2.5μA, a current of only 1.5μA is available to drive the motor.

To achieve this, using a conventional 1 Hertz driving pulse as in watch A (with a seconds hand), it would be possible to use a wire of smaller diameter, to provide a winding of greater resistance, and hence reduction of the current consumption and of the driving torque. This, however, has the serious disadvantage of a great increase in the cost of the windings, as the wire diameter is reduced. The cost multiplies by 10 for a halving of the diameter. The winding operation also becomes far more difficult, appreciably reducing manufacturing efficiency.

Instead, the new arrangement of what B (without a seconds hand) maintains the same winding parameters but reduces the frequency of the driving pulses by one-fifth, using 12 as the value of N and employing five-second pulses. As shown by the Table, the current consumption of the motor drops to a mean value of 1.35μA, and the torque on the minutes hand arbor to 1.2 g. cm. These values are compatible with the proposed use.

Moreover, the reducing gear train is simplified (ratio 1:360 instead of 1:1800) since a part of the division provided by the gear train of watch A is carried out by the electronic circuit. This simplification of the gear train is particularly advantageous in a very small watch.

Watch C is a low-cost gentlemen's wristwatch, a gain without a seconds hand or calendar mechanism.

Here, the diameter of the winding wire is increased to 50μm.

The following advantages are obtained:

(a) The cost of the wire for the manufacture of a winding drops materially. It amounts to 0.29 Swiss Francs for watches A and B and only to 0.04 Francs for C.

(b) As the number of windings is four times less, the winding operation is shorter.

(c) The increased diameter of the wire simplifies the winding operation and increases its efficiency.

(d) The magnetic field in the winding becomes four times greater, which enables use of a more economic magnetic circuit.

(e) The reducing gear train is simplified by elimination of at least one wheel (ratio of 1:120 instead of 1:1800).

It is also observed that the mean current consumption remains practically the same in watch C as in A, and the same 150 mAh cell as in A can be used. In watch B the mean current consumption is smaller, and a smaller cell can be used, or the usual cell can be used longer.

The torque on the minutes hand arbor drops 1.5 g. cm. in watch C; this is compatible with the type of watch in question.

To conclude the comparison of A and C: A involves a lesser current consumption of the motor and a standard manufacturing cost; watch C has a motor with about the same current consumption as A but with a substantial reduction of the manufacturing cost.

Watch B has greatly reduced current consumption.

It may finally be noted (Embodiment D) that signals S2 of 1/60 Hz conveniently have a value of 2mA with a pulse duration of 30 millisecond. This value is far greater than that for known watches with 1 Hz signals supplied to a step-by-step motor to drive a second display hand, for which the valve is about 200μA with the same pulse duration of 30 millisecond. There is therefore a considerable reduction in consumption of electric power compared to the known watch.

In all embodiments of the watch according to the invention, motor 3 can be provided with thicker wire than usual, which is hence cheaper and easier to wind.

The use of Ferrites or Ticonal for the magnets of motor 3, instead of Pt-Co or Sm-Co, is preferred, as it also enables the cost of the motor to be reduced.

By taking signals S3 off from the output of the last-but-six stage of divider 2, as indicated by FIG. 2, signal S3 conveniently has a frequency of 64/60 Hz but, if desired, a known type of corrector device 19 can be provided in divider 2 to correct this signal to exactly 1 Hz, thus giving a flashing optical seconds display.

The watch can also be furnished with any known devices enabling its adjustment and thermal compensation. A zero setting switch can also be provided on the last stages of divider 2 to enable setting to the exact time.

The new watch lends itself very well to modular manufacture and to rationalisation of manufacture and assembly.

All of the new watches B, C and D offer the same advantages as compared to known watches employing corresponding oscillators: robustness and lower consumption. In addition, suppression of the seconds motion enables watch movements of less height to be obtained.

What I claim and describe to secure by Letters Patent is:

1. An electronic watch, comprising;

a time base of at least sonic frequency;

frequency divider means for driving said frequency to deliver output pulses at a low output frequency of N/60 cycles per second, where N is a whole number included between 1 and 16, and with a pulse duration (pulse width) ranging from about 10 to about 30 milliseconds;

a low-frequency step motor having at most 10,600 windings of wire of at least 25 micron thickness energized step-by-step by said output pulses; and a time display unit, including as a most rapidly rotating element thereof, a minutes display member driven directly by said motor by one step per output pulse, and a watch dial for the driven display member.

2. A watch according to claim 1 in which the frequency divider means comprises means for delivering the output pulses at a frequency of about 1/15 Hertz (N=4/60 cycles per second) and with a pulse duration of about 10 milliseconds.

3. A watch according to claim 1 in which the frequency divider means comprises means for delivering the output pulses at a frequency of about 1/15 Hertz (N=4/60 cycles per second) and with a pulse duration of about 10 milliseconds, the motor having approximately 2650 windings of about 50 micron thickness.

4. A watch according to claim 1 in which the frequency divider means is enabled to deliver output pulses with a frequency of about 1/15 Herz (N=4/60 cycles per second) and with a pulse duration of about 10 milliseconds, the motor having windings of about 50 micron thickness.

5. A watch according to claim 1, in which the frequency divider means includes intermediary means for deriving an optically perceptible frequency; and optical means for optically displaying a visual signal at the optically perceptible frequency derived from the intermediary means of the frequency divider means.

6. A watch according to claim 5 in which said optical display means comprises a liquid crystal cell located on said time display unit.

* * * * *